US007103146B2

(12) United States Patent
Lenz et al.

(10) Patent No.: US 7,103,146 B2
(45) Date of Patent: Sep. 5, 2006

(54) ROTARY PISTON TUBE FOR AN X-RAY RADIATOR

(75) Inventors: Eberhard Lenz, Erlangen (DE); Peter Rother, deceased, late of Baiersdorf (DE); by Jutta Rother, legal representative, Baiersdorf (DE); Peter Schardt, Aisch (DE)

(73) Assignee: Siemens Aktiengesellschaft, Munich (DE)

( * ) Notice: Subject to any disclaimer, the term of this patent is extended or adjusted under 35 U.S.C. 154(b) by 168 days.

(21) Appl. No.: 10/860,898

(22) Filed: Jun. 4, 2004

(65) Prior Publication Data

US 2004/0258208 A1 Dec. 23, 2004

(30) Foreign Application Priority Data

Jun. 5, 2003 (DE) ..... 103 25 463

(51) Int. Cl.
*H01J 35/18* (2006.01)
*H01J 35/10* (2006.01)
*H01J 35/16* (2006.01)
*H01J 35/14* (2006.01)

(52) U.S. Cl. ..... 378/140; 378/121; 378/125; 378/137; 378/161

(58) Field of Classification Search ..... 378/119, 378/121, 125, 137, 140, 144, 161
See application file for complete search history.

(56) References Cited

U.S. PATENT DOCUMENTS 3,878,417 A * 4/1975 Eberlein ..... 378/161
4,045,699 A * 8/1977 Gunther ..... 378/161
4,122,967 A * 10/1978 Rohrich ..... 220/2.3 R
4,229,657 A * 10/1980 Bensussan et al. ..... 378/125
4,993,055 A * 2/1991 Rand et al. ..... 378/125
5,173,931 A * 12/1992 Pond ..... 378/130
5,883,936 A 3/1999 Hell et al. ..... 378/125
5,898,755 A * 4/1999 Meusel et al. ..... 378/137
6,084,942 A 7/2000 Hell et al. ..... 378/200
6,118,852 A * 9/2000 Rogers et al. ..... 378/140
6,148,061 A * 11/2000 Shefer et al. ..... 378/121
6,339,635 B1 * 1/2002 Schardt et al. ..... 378/137
6,419,389 B1 7/2002 Fuchs et al. ..... 378/199
6,459,768 B1 * 10/2002 Koller et al. ..... 378/140

FOREIGN PATENT DOCUMENTS

DE 230 110 A1 11/1985
DE 42 04 301 A1 2/1993

(Continued)

OTHER PUBLICATIONS

DIN EN 10273 (English Version) Hot Rolled Weldable Steel Bars for Pressure Purposes with Specified Elevated Temperature Properties, Apr. 2000.

(Continued)

*Primary Examiner*—Allen C. Ho
(74) *Attorney, Agent, or Firm*—Schiff Hardin LLP

(57) ABSTRACT

A rotary piston tube for an x-ray radiator is provided in which the vacuum housing, accommodating an anode and a cathode and displaceable in rotation, comprises a 360° all-around ray exit window. For optimization of the ray exit window, this is produced according to one of the subsequently stated material specifications: a) a high-temperature steel or a high-temperature chromium and/or nickel alloy, listed in the standard EN 10273 and EN 10302, at a wall thickness between 0.1 to 0.4 mm; b) a titanium material at a wall thickness between 0.2 and 2 mm; and c) a ceramic material at a wall thickness between 1 mm and 5 mm.

14 Claims, 2 Drawing Sheets

FOREIGN PATENT DOCUMENTS

| | | | |
|---|---|---|---|
| DE | 196 31 899 | A1 | 2/1998 |
| DE | 197 41 750 | A1 | 3/1999 |
| DE | 198 10 346 | C1 | 10/1999 |
| DE | 199 00 467 | A1 | 4/2000 |

OTHER PUBLICATIONS

DIN EN 10302 (English Version) Creep Resisting Steels, Nickel and Cobalt Alloys, Sep. 2002.

* cited by examiner

ROTARY PISTON TUBE FOR AN X-RAY RADIATOR

BACKGROUND OF THE INVENTION

The invention concerns a rotary piston tube for an x-ray radiator with a vacuum housing accommodating an anode and a cathode, and displaceable in rotation, the vacuum housing being fashioned in a frustum shaped manner and expanding towards the anode, and comprising on the expanded end a 360° all-around ray exit window connected with the anode plate of the anode.

X-ray radiators that are equipped with rotary piston tubes normally comprise a vacuum housing, positioned such that it can rotate in the radiator housing, in which a cathode arranged is arranged on one side and an anode is arranged on the other side along a common rotation axis. In the known rotary piston tubes, the vacuum housing is fashioned mostly in a piston-like manner, with a cylindrical section and an abutting, frustum-shaped section expanding towards the anode. Located around the cylindrical section and outside of the vacuum housing is a device to deflect and focus the electron beam generated by the cathode on the impinging region of the anode. The stated device is fixed with regard to the rotating vacuum housing such that the electron beam is always deflected in the same direction, and thus always impinges on the impinging region of the rotating anode. The electron beam can be focused on, for example, a line-shaped focal spot with the aid of the invention.

Rotary piston tubes of this type are, for example, specified in German Patent Documents DE 196 31 899 A1, DE 197 41 750 A1 and DE 198 10 346 C1.

To provide a targeted exit of the x-rays from the radiator housing upon rotation of the vacuum housing, such rotary piston tubes require the ray exit window in the vacuum housing to unavoidably be fashioned as a 360° all-around window. Also, so that the electron deflection functions, the main part of the vacuum housing (thus the frustum-shaped section of the vacuum housing) must be comprised of a non-magnetizable material.

In the known embodiments, the vacuum housing has been produced from a non-magnetizable, vacuum-sealed steel plate (for example, from a steel grade material with the German material number W. No. 1.4301). The wall thickness of the vacuum housing in these embodiments goes down to approximately 2 mm, whereby for reasons of rigidity, the same wall thickness (or only a slightly reduced wall thickness) is provided in the region of the exit window. Due to the mechanical stressing of the tube (the tube rotates in operation with up to approximately 9000 RPM), for reasons of rigidity, and also due to the danger of a warpage upon heating of the tube, it is not possible to dimension the exit window in this material significantly thinner than 0.5 mm (in order to be able to reduce the radiation loss) given the materials used up to now.

Furthermore, previously no measures for improved (i.e., more efficient in terms of production and maintenance) fashioning of the ray exit window have been achieved, which ultimately means that the entire tube would have to be exchanged given wearing/deterioration of the window condition as a consequence of the electron bombardment.

SUMMARY OF THE INVENTION

The invention is based on the object to provide an alternative rotary piston tube for an x-ray radiator. In contrast to the known embodiments, the rotary piston tube according to the invention is particularly enhanced in the region of the ray exit on the vacuum housing, and there optimized with regard to the radiation losses. Furthermore, a better result is achieved with regard to the production of the tube and the service in the case of wearing of the ray exit window.

The stated object is inventively achieved via a specific selection of materials and wall thicknesses for production of at least the ray exit window as well as possibly also of the entire vacuum housing.

The steels and chromium (Cr) alloys as well as nickel (Ni) alloys in question are listed under the standard EN 10302 and EN 10273, and are characterized according to the steel key with a German material number (WN).

Particularly suitable and preferably usable materials are, for example, the materials characterized with the designations WN 1.4903, WN 1.4922, WN 1.4539 or WN 1.7701.

Given use of a steel, for example, a steel with the material number 1.4903, the ray exit window can be produced with a very thin wall thickness of 0.2 mm. Such an embodiment can be viewed as optimal and particularly advantageous because a still-acceptable concentricity of the tube of 0.05 mm can be achieved with this conception under the load to which the tube is exposed in operation.

In tubes that are exposed to high stresses, it is advantageous to use high-temperature high-strength steels such as, for example, WN 1.4922 or 1.4903 for the window region and the exit window.

Given use of high-temperature steels and high-temperature Cr and Ni alloys, as well as with titanium materials insofar as they are not magnetizable, one can also proceed such that ray exit window and vacuum housing are fashioned as one part. The use of an austenitic stainless steel, preferably one with the German material number WN 1.4539, has proven to be particularly advantageous for such a one-part version.

In addition to pure titanium (Ti), high-temperature Ti alloys, for example TiAlV64, can also be used. With such materials, similarly thin wall thicknesses can be achieved for the window region or the vacuum housing because titanium is inherently sufficiently stable, possesses radiation-weakening properties, has no residual magnetism, and has a relatively low electrical conductivity.

Given application of ceramic materials, $Al_2O_3$ has appeared to be particularly advantageous. This ceramic material has sufficient rigidity, is comparably inexpensive, and is simple to solder.

With regard to possibly ensuing repairs given wearing of the ray exit window, it can be advantageous to fashion the ray exit window as a separate component in the form of a welded ring in which the window contour is incorporated. Given tube failure, only the ring needs to be exchanged. The component can be fashioned as a window module that can be connected with the vacuum housing on one side and with the anode plate on the other side, this window module being comprised of two annular load-bearing parts made of non-magnetic stainless steel and an intermediately arranged ring made of titanium. The ring can be formed from a titanium plate welded or soldered with the annular load-bearing parts and produced in the drawing or spinning method. Alternatively, the ring can also be worked from a correspondingly dimensioned tube.

DESCRIPTION OF THE DRAWINGS

Further advantages are to be learned from the description and drawings below describing various embodiments of the invention.

DETAILED DESCRIPTION OF THE PREFERRED EMBODIMENTS

Figure 1:
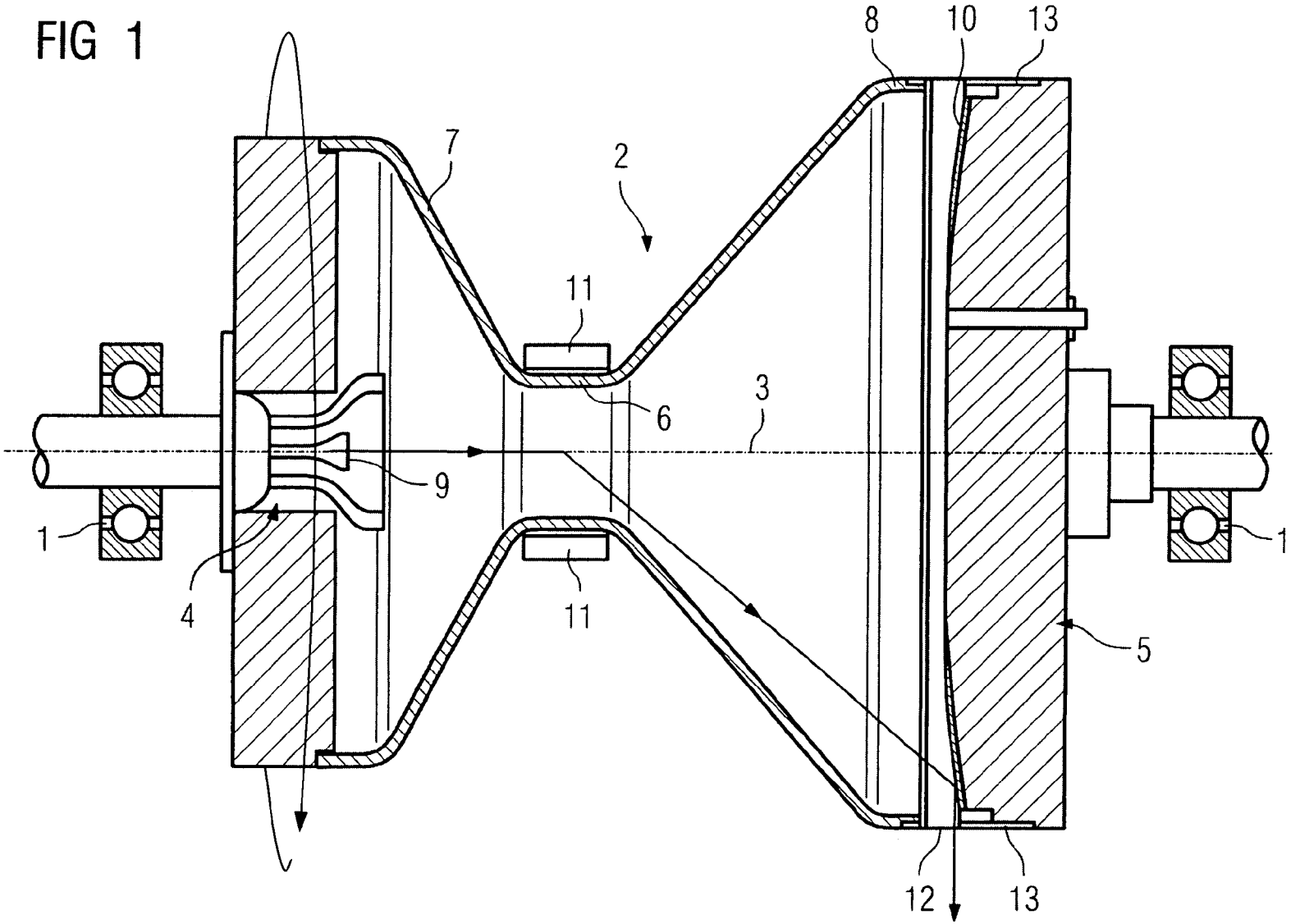
FIG. 1 is a longitudinal section of an embodiment of a rotary piston tube according to the invention.

In a simplified representation, FIG. 1 shows an embodiment of a rotary piston tube according to the invention in longitudinal section. The following text describes various embodiments of the invention.

The rotary piston tube is positioned in a known manner such that it can rotate in a radiator housing (not shown in the Figure). For this, corresponding bearings 1 are present on both sides of the rotary piston tube. In order to displace the rotary piston tube in rotation, a correspondingly fashioned drive/actuator is present at a suitable location. Because these parts are known from the prior art, these are not shown and described in detail.

In the shown embodiment, the rotary piston tube comprises a vacuum housing 2 fashioned as a double cone, in which a cathode arrangement 4 is arranged on one side and an anode 5 is arranged on the other side along a common rotation axis 3. The vacuum housing 2 is fashioned like a piston and approximately has in the center a cylindrical section 6 and frustum-shaped sections 7, 8 abutting on this section 6 on both sides. Located at the end of the frustum-shaped section 7 is the cathode arrangement 4 with a flat emitter 9, and located at the end of the other section 8 is the anode 5 with an anode plate 10.

Located around the centrally placed cylindrical section 6, outside of the vacuum housing 2, is a device 11 that serves to deflect the electron beam and focus on the impinging region of the anode plate 10 (see arrow). The cited device 11 is fixed with regard to the rotating vacuum housing 2, such that the electron beam always deflects in the same direction and always impinges on the impinging region of the rotating anode plate 10. The electron beam can be set on a line-shaped focal spot with the invention.

In the shown embodiment, the ray exit window 12 is a separate, annularly-fashioned component which is connected on one side with the frustum-like section 8 of the vacuum housing 2 and on the other side with a buffer part 13 soldered to the anode plate 10. The buffer part 13 serves to absorb possible expansions ensuing in the anode region due to heat development. The connection with the ray exit window 12 ensues via welding.

The ray exit window 12 is fashioned as a 360° all-around part and must be correspondingly stable since it is part of the vacuum enclosure.

Figure 2:
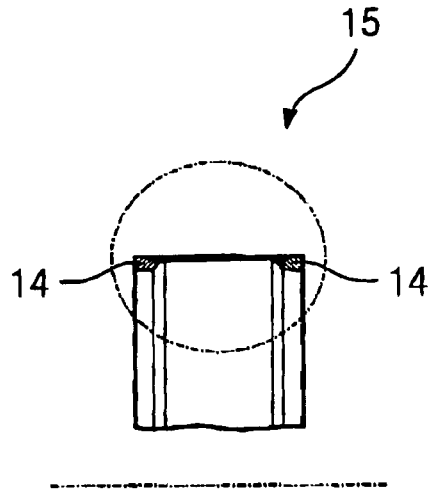
FIG. 2 is a pictorial view of a part of a window ring in section.
Figure 3:
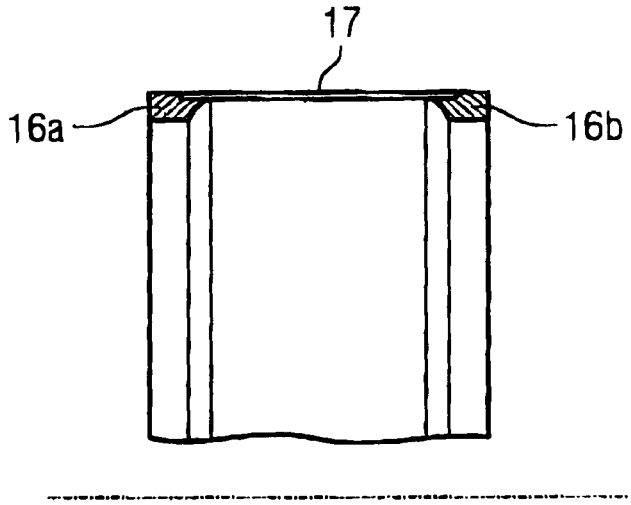
FIG. 3 is a section from FIG. 2, shown enlarged.
Figure 4:
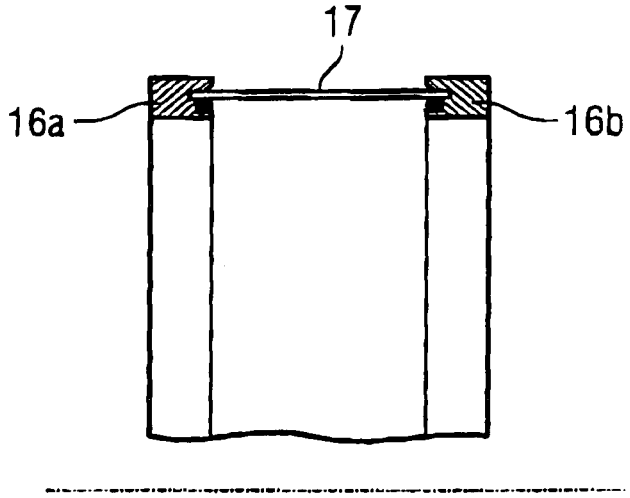
FIG. 4 is a section of the ring shown in FIG. 3 as a blank.

As is visible from FIG. 2, the ray exit window 12 is comprised of an annular component 14 with incorporated window contour 15. From FIG. 3, which reproduces, in an enlarged manner, the section marked with dash-dot lines in FIG. 2, the window contour 15 is visible that is formed by a thin ring 17 attached on both sides by annular load-bearing parts 16*a*, 16*b*. FIG. 4 shows the parts in a raw state. The ring 17 is soldered or welded between both load-bearing parts 16*a*, 16*b*. For completion, the blank is stripped on the correspondingly provided stop measure/gauge block.

Given use of one of the previously cited high-temperature materials, the ring 17 can exhibit a wall thickness of preferably 0.2 mm.

The previously mentioned chromium steels, stainless steels, and Cr and Ni alloys, as well as titanium and titanium alloys, are considered as further materials for the ray exit window 12.

The ring can advantageously be a deep-draw or spin part made from suitable material, for example, from a thin titanium plate, or also be created from a tube with the corresponding dimensions.

As an alternative to the specified versions, the ray exit window 12 can also be completely executed as one part. In this case, the entire window can be formed from a deep-draw part or spin part which is welded with the vacuum housing and the anode plate or the buffer part arranged between them.

As a further alternative to the specified versions, the ray exit window 12 can also be executed together with the parts of the vacuum enclosure 6, 7, 8. The materials cited above are considered as viable materials, with the exception of the ferritic steels.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. For the sake of brevity, conventional electronics and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 bearing
2 vacuum housing
3 rotation axis
4 cathode arrangement
5 anode
6 cylindrical section
7 frustum-shaped section
8 frustum-shaped section
9 flat emitter
10 anode plate
11 deflection and focusing device
12 ray exit window
13 buffer part

14 annular component
15 window contour
16*a*, 16*b* annular load-bearing parts
17 ring

What is claimed is:

1. An X-ray radiator rotary piston tube that is rotatably displaceable, comprising:

a vacuum housing accommodating an anode with anode plate and a cathode, the vacuum housing being configured in a frustum-shaped manner and expanding towards the anode thereby making an expanded end, the expanded end comprising a 360° all-around ray exit window connected with the anode plate, the ray exit window being made according to a specification selected from the group consisting of:

a) a high-temperature high-strength steel or at least one of a high-temperature chromium and nickel alloy, listed in the standard EN 10273 and EN 10302, at a wall thickness between 0.1 to 0.4 mm;

b) a titanium material at a wall thickness between 0.2 and 2 mm; and c) from a ceramic material at a wall thickness between 1 mm and 5 mm.

2. The X-ray radiator according to claim 1, wherein the ray exit window is produced having a wall thickness of 0.2 mm when using a high-temperature high-strength steel.

3. The X-ray radiator according to claim 1, wherein the ray exit window is produced from chromium steel, listed in the standard EN 10273, when using a high-temperature high-strength steel.

4. The X-ray radiator according to claim 1, wherein the ray exit window is produced with a wall thickness of 0.6 mm when using a titanium material.

5. The X-ray radiator according to claim 1, wherein the ray exit window is produced with a wall thickness of 3 mm when using a ceramic material.

6. The X-ray radiator according to claim 1, wherein the ray exit window is produced as a separate part, and is configured to be connectable with the vacuum housing with the aid of a vacuum brazing solder.

7. The X-ray radiator according to claim 1, wherein the ray exit window is produced as a separate part, and is configured to be connectable with the vacuum housing with the aid of an expandable or deformable active solder.

8. The X-ray radiator according to claim 1, wherein the ray exit window and the vacuum housing are fashioned as one part when using a high-temperature steel or a titanium material.

9. The X-ray radiator according to claim 1, wherein the ray exit window is fashioned as a window module that is configured to be connected with the vacuum housing on one side and with the anode plate on an other side.

10. The X-ray radiator according to claim 9, wherein the window module comprises a ring made from a titanium material and load-bearing parts made from non-magnetic stainless steel on both sides of the ring.

11. The X-ray radiator according to claim 10, wherein the ring is formed from a plate made from titanium or a titanium alloy, produced in a drawing or spinning method, and connected with the load-bearing parts via soldering or welding.

12. The X-ray radiator according to claim 10, wherein the ring is a tube-formed ring.

13. The X-ray radiator according to claim 1, further comprising an expansion compensation element that is arranged between the ray exit window and the anode plate.

14. The X-ray radiator according to claim 1, wherein the vacuum housing is a double cone vacuum housing.

* * * * *